United States Patent [19]

Balderson et al.

[11] Patent Number: 4,999,049

[45] Date of Patent: Mar. 12, 1991

[54] THICK FILM ELECTRICALLY RESISTIVE TRACK MATERIAL

[75] Inventors: Simon N. Balderson, Reading; Alan R. Atterbury, Eastcote, both of England

[73] Assignee: Thorn EMI plc, London, England

[21] Appl. No.: 220,671

[22] Filed: Jul. 18, 1988

[30] Foreign Application Priority Data

Jul. 18, 1987 [GB] United Kingdom ..... 8717035

[51] Int. Cl.[5] ..... C22C 29/12

[52] U.S. Cl. ..... 75/234; 75/235; 219/553; 252/512; 252/513; 252/521

[58] Field of Search ..... 75/234, 235; 219/553; 252/521, 512, 513

[56] References Cited

U.S. PATENT DOCUMENTS

| | | | |
|---|---|---|---|
| 3,484,284 | 12/1969 | Dates et al. | 117/221 |
| 4,517,545 | 5/1985 | Merz | 338/85 |
| 4,859,835 | 9/1989 | Balderson | 219/543 |

FOREIGN PATENT DOCUMENTS

| | | |
|---|---|---|
| 469075 | 1/1975 | Australia . |
| 489968 | 6/1975 | Australia . |
| 0057456 | 8/1982 | European Pat. Off. . |
| 0092155 | 10/1983 | European Pat. Off. . |
| 0125034 | 11/1984 | European Pat. Off. . |
| 990023 | 4/1965 | United Kingdom . |

OTHER PUBLICATIONS

Introduction to Physics for Scientists and Engineers, (author unknown), p. 394.

*Primary Examiner*—Stephen J. Lechert, Jr.
*Assistant Examiner*—Nina Bhat
*Attorney, Agent, or Firm*—Fleit, Jacobson, Cohn, Price, Holman & Stern

[57] ABSTRACT

An electrically resistive track suitable for use as a heating element consists of a thick film including a base metal constituent and a glass constituent. The thick film has in the temperature range of from 20° C. to 600° C. a temperature coefficient of resistance (TCR) less than 0.0050 per degree C. Suitable metal constituents include tungsten, molybdenum, a mixture of nickel and tungsten and a mixture of nickel and chromium.

8 Claims, 3 Drawing Sheets

THICK FILM ELECTRICALLY RESISTIVE TRACK MATERIAL

The present invention relates to thick film electrically resistive track materials, and it relates especially, though not exclusively, to such materials as may be applied by any convenient means to a suitable substrate for use as high power heater tracks.

Our co-pending European Patent Application No. 88301518.2 advocates the use of materials exhibiting a high temperature co-efficient of resistance (TCR), i.e. in excess of 0.006 per degree C in the temperature range of from 0° C. to 550° C., as thick film, high power heater tracks, and indeed when used, for example, as the means of heating the heated areas of a cooktop or hob, there is considerable advantage in using such materials, since the high initial current drawn contributes to rapid warming up of the heated areas and can be tolerated by the supply circuit and its associated fuse(s).

There are circumstances, however, when the high initial current surge cannot be tolerated by the fuse associated with an appliance incorporating a heater. Examples of such circumstances include usage in appliances such as kettles, irons and fan heaters which have relatively high power requirements yet are protected by fuses of only 13 ampere capacity.

Furthermore, a cooker hob consisting of e.g. four such heating elements may need to be designed so that the elements could not be switched on within a few seconds of each other. Such control is expensive and could offset the low cost advantage of the heating element itself. The potential lack of user control of a heating element whose power dissipation varies greatly with temperature can also be considered a disadvantage in certain circumstances.

Accordingly, there is a requirement for heater track materials which are robust, cheap and readily applied to suitable substrates as thick films but which do not exhibit the high TCR of conventional base metal thick film materials (e.g. nickel and cobalt), and it is an object of this invention to provide such materials.

It is a further object of this invention to provide heater tracks and heater elements formed of or including such materials.

According to the present invention there is provided an electrically resistive track suitable for use in a heating element, said track consisting of a thick film including a base metal constituent and a glass constituent, said thick film having in the temperature range of from 20° C. to 600° C. a temperature coefficient of resistance (TCR) less than 0.0050 per degree C. Such electrically resistive tracks are readily manufactured as thick film tracks on suitable substrates but do not exhibit as high a TCR as conventional base metal thick film tracks and so can be used in circumstances where the high initial current surge characteristic of the high TCR tracks cannot be tolerated.

For the avoidance of doubt, it is hereby stated that the TCR of a material at a given temperature T is given by:

$$\frac{R(T) - R(k)}{(T - k)R(k)}$$

where k=a constant temperature=20 ° C. in the present specification.

R(T)=resistance of a sample of the material at temperature T.

R(k)=resistance of the same sample of the material at temperature k.

In order that the invention may be clearly understood and readily carried into effect, some embodiments thereof will now be described, by way of example only, and with reference to the accompanying drawings in which.

A heating element comprising a thick film electrically resistive track has a composition by weight in the range of from 50% metal/50% glass to 95% metal/5% glass, preferably a composition by weight of 80% metal powder and 20% glass powder. A typical, but non-limiting, glass powder used has the percentage composition by weight as below:

| | |
|---|---|
| $SiO_2$ | 73.39 |
| $Al_2O_3$ | 6.43 |
| CaO | 1.29 |
| $K_2O$ | 0.32 |
| $Na_2O$ | 6.29 |
| BaO | 2.71 |
| $B_2O_3$ | 9.57 |

In general, the glass for the thick film track has a melting point of about 800° C. This enables the ink from which the track is to be made to be fired at a high temperature to ensure effective sintering of the metal without the glass bleeding out. The high melting point of the glass also provides high temperature stability. The composition of the glass is chosen so that the thermal expansion coefficient of the thick film is compatible with that of a substrate to which the track is to be applied.

The proportion of metal to glass in the thick film used affects, inter alia, the following properties:

(a) The resistivity/conductivity of the thick film. This affects the possible power dissipation of heater tracks made of the thick film.

(b) The thermal expansion coefficient of the thick film. This should be compatible with that of a substrate to which the thick film is to be applied.

(c) The adhesion of the thick film to a substrate to which the thick film is to be applied—if the proportion of metal is too high, the thick film will not adhere to the substrate.

One method of manufacturing an electrically resistive thick film track suitable for a heating element is described hereinafter.

Glass powder of average particle size 5.0μm and a powder of the metal constituent having the required particle size (as discussed further hereinafter) are mixed in the required ratio with a screen printing medium, such as ESL 400, in a sufficient quantity to form a thick liquid slurry with a viscosity that allows the slurry to be easily screen printed. The mixture is then passed through a triple roll mill to ensure adequate wetting of the metal and glass powders, by the screen printing medium, forming an ink. The resulting ink is screen printed in the desired pattern onto the substrate, dried at 150° C. and fired at 1100° C. The firing procedure is preferably carried out in a nitrogen atmosphere to prevent oxidation of the metal.

Figure 1:
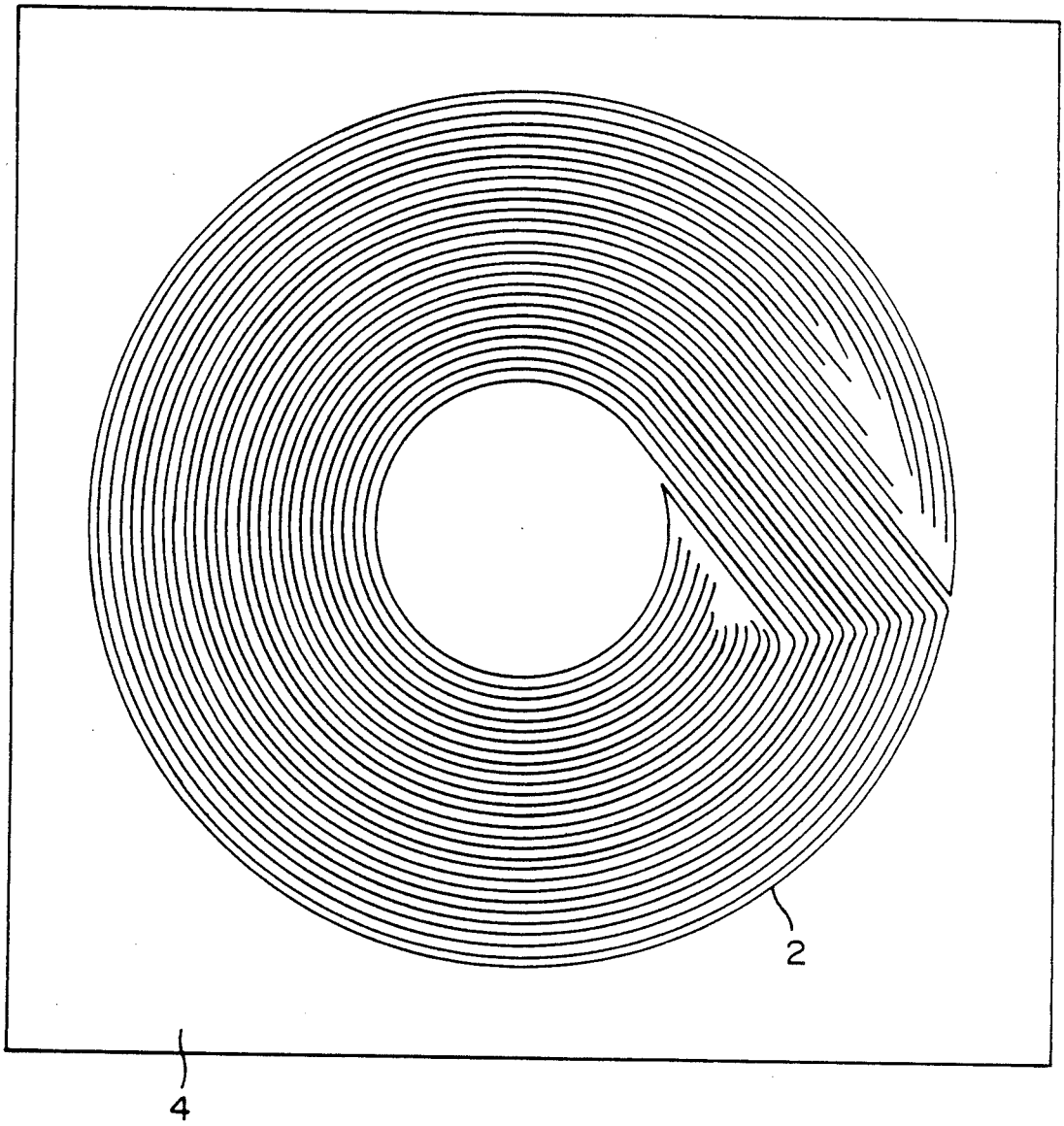
FIG. 1 shows, in plan view, a heating element comprising an electrically resistive track provided in accordance with the invention, the track being applied to a substrate.

A suitable pattern for the track is as shown in FIG. 1 which shows a heating element 2 on a substrate 4. The heating element 2 is connected to a power supply by electrical connectors (not shown).

Thick film tracks provided in accordance with the present invention may advantageously be deposited upon substrates of the kind described in our copending European patent application No. 88301519.0. This describes and claims a substrate for supporting electrical components, said substrate comprising a plate member having on at least one surface a layer of a glass ceramic material wherein the percentage porosity of the glass ceramic layer, as defined hereinafter, is equal to or less than 2.5.

By percentage porosity is meant the porosity at a random cross-sectional plane through the substrate perpendicular to the plate member expressed as the percentage ratio of the cross-sectional area of pores on the plane to the cross-sectional area of the remainder of the glass ceramic layer on that plane.

The inventors have discovered that two materials not traditionally used in thick film form have all the properties required for high power conductor tracks. These materials are tungsten and molybdenum. The resistivity and TCR of these metals is below that of nickel, they have high melting temperatures and are readily available in fine powder form. They are not used in conventional thick film applications because the sintering temperature required to achieve resistivity values comparable with the bulk metal is greater than 1500° C., well above conventional thick film processing temperature.

The inventors prepared tungsten and molybdenum thick film heater tracks, using the method outlined above, producing tracks with conductivity similar to that of standard thick film nickel. This has been achieved using low particle size powders ( 0.5μm tungsten and 2μm molybdenum) and processing at 1100 ° C. Processing temperatures of this order allows these materials to be applied to ceramic coated metals which show serious degradation at higher temperatures. The track resistivity is above that which could be achieved at higher firing temperatures but these tracks still possess all the advantageous properties associated with these materials. Once overglazed to protect them from oxidation, tungsten and molybdenum thick film heater tracks have potential in several applications, e.g. low temperature, low power density applications.

As indicated above, a tungsten thick film track can be manufactured from tungsten powder of average particle size 0.5μm. Powders having an average particle size in the range of from 0.1μm to 5.0μm can be used. The TCR of the tungsten thick film track produced is about 0.0046 per degree C and its electrical resistance at room temperature is about 22 m Ω per square per micron.

Also as indicated above, a molybdenum thick film track can be manufactured from molybdenum powder of average particle size 2 μm. Powders having an average particle size in the range of from 0.μm to 5.0μm can be used. The TCR of the molybdenum thick film track produced is about 0.0043 per degree C and its electrical resistance at room temperature is about 22 m Ω per square per micron.

The range of average particle size of the powders that are used is particularly critical for tungsten and molybdenum because, as indicated hereinbefore, it has conventionally been accepted that for these metals the sintering, i.e. firing, temperature required to achieve resistivity values of the thick film comparable with those of the bulk metal is greater than 1500° C., well above conventional thick film processing tempeatures. The inventors realised that thick films of tungsten and molybdenum can be produced using a sintering temperature of 1100° C. if the average particle size of the powder was sufficiently small, though not so small that the particles could leach into the substrate during the firing process.

Figure 2:
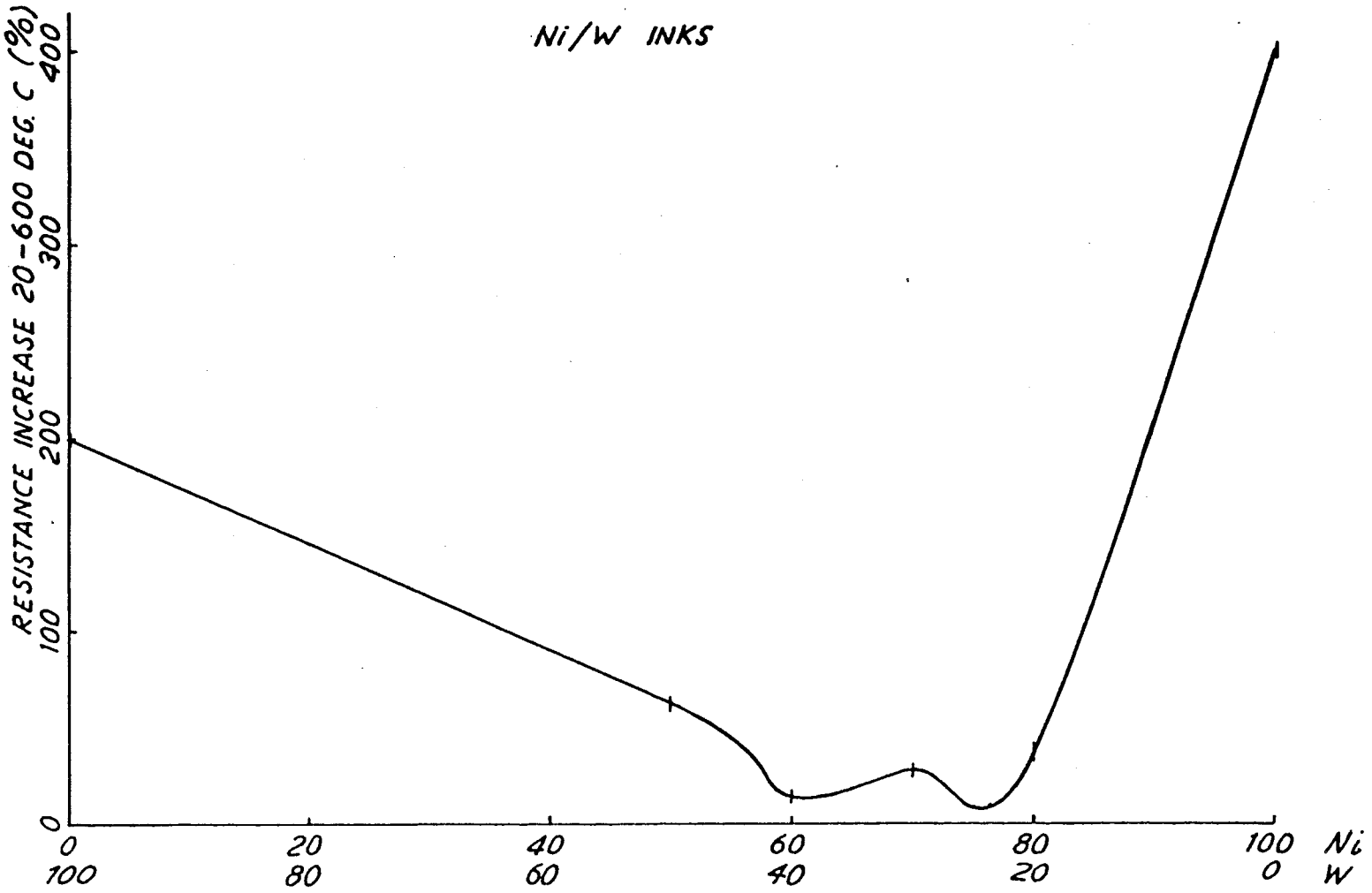
FIG. 2, is a graph showing the percentage variation of electrical resistance over the range 20° C. to 600° C. with composition of a thick film material having as metal constituent a mixture of nickel and tungsten.

The inventors anticipated, from the results obtained with the above materials and comparing them with tracks formed of nickel, that thick films containing blends of nickel and tungsten would show TCR values intermediate between those of thick films having as metal constituent the pure metals and therefore give little or no advantage. However they have found that such mixtures can result in TCR values significantly below those of the metals. This can be seen in FIG. 2 which illustrate graphically data obtained using mixtures of 4–7 μm nickel powder, i.e. average particle size 5.5μm, with 0.3 to 0.5 μm tungsten powder i.e. average particle size 0.4 μm and processing at 1100° C. for 10 mins. The thick film track was manufactured as outlined hereinbefore with the mixture of nickel and tungsten forming the metal constituent of the glass/metal powder mixture. The preferred average particle size for both the nickel and tungsten powders is in the range of from 0.1 μm to 5.5 μm.

From the definition of TCR given hereinbefore, the TCR of a composition is given by:

$$\frac{\%\text{ resistance increase}}{100X\text{ temperature increase}} = \frac{\%\text{ resistance increase}}{580 \times 100}$$

i.e. a % resistance increase of 200 corresponds to a TCR of 0.0034. Thus thick film materials containing nickel and tungsten having a TCR less than the TCR of a thick film with the metal constituent only of nickel or of tungsten can be obtained when the nickel and tungsten mixture has a relative proportion by weight in the range of from just under 100% tungsten to about 85% nickel/15% tungsten. Thick film materials containing nickel and tungsten having a TCR of less than 0.0050 per degree C, i.e. corresponding to a resistance increase of 290% in the temperature range of 20° C. to 600° C., can be obtained when the nickel and tungsten mixture has a relative proportion by weight in the range of from 100% tungsten to about 90% nickel/10% tungsten. For a TCR of less than 0.0010 per degree C, corresponding to a resistance increase of 60% in the temperature range of 20° C. to 600° C., the nickel and tungsten mixture has a relative proportion by weight in the range of from about 50% nickel/50% tungsten to about 80% nickel/20% tungsten. A minimum TCR is produced when the relative proportion by weight of the two metals is 60% nickel/40% tungsten or about 75% nickel/25% tungsten.

Figure 3:
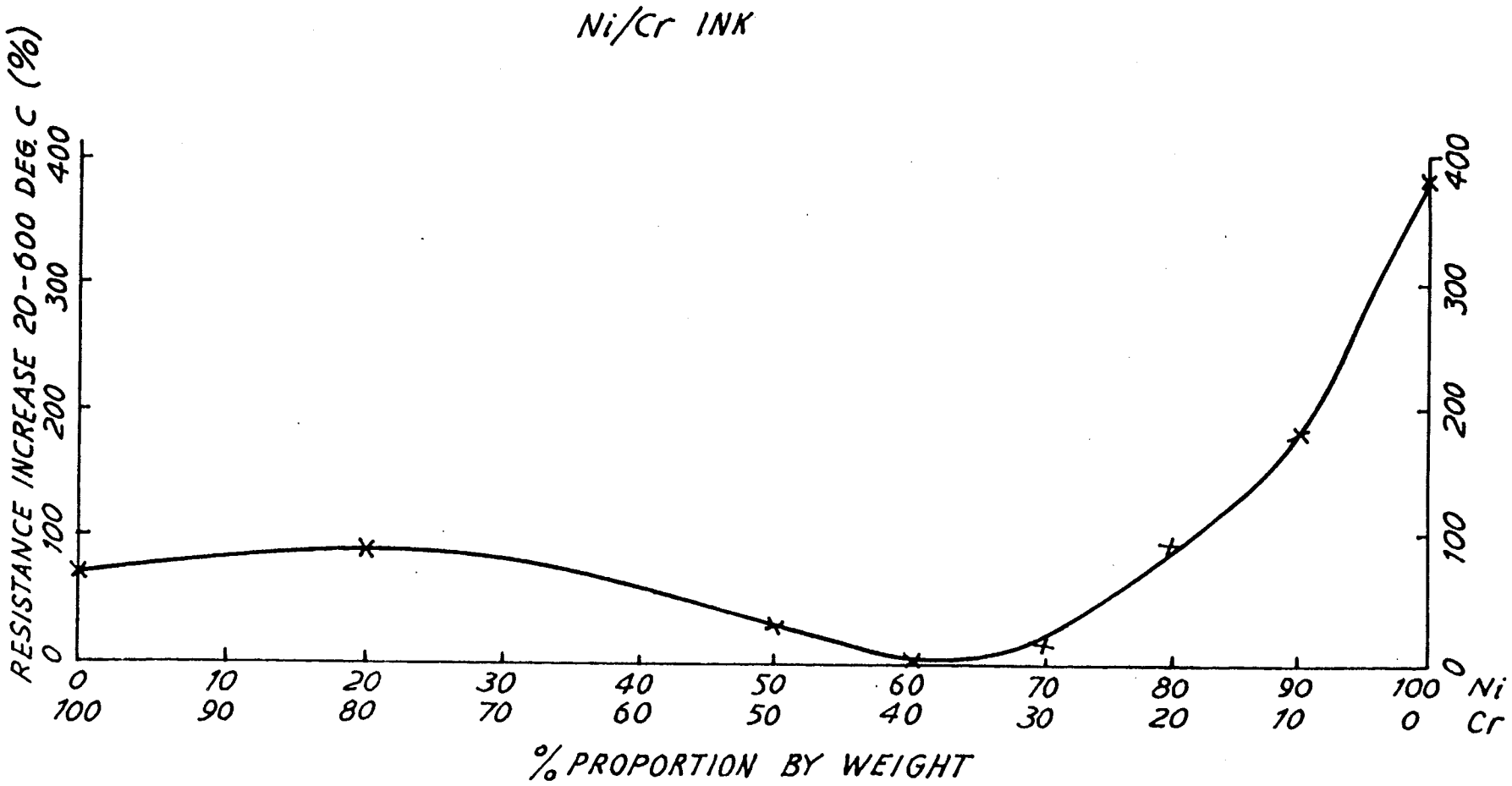
FIG. 3 is a graph showing the percentage variation of electrical resistance over the range 20° C. to 600° C. with composition of a thick film material having as metal constituent a mixture of nickel and chromium.

Similar results, as shown in FIG. 3, were achieved when a thick film track formed of a glass powder and a mixture of nickel and chromium powders was manufactured as outlined hereinbefore. The preferred average particle size for both the nickel and chromium powders is in the range of from 0.1 μm to 5.0 μm.

Thick film materials containing nickel and chromium and having a TCR less than the TCR of a thick film with the metal consituent consisting only of nickel or chromium can be obtained when the nickel and chromium has a relative proportion by weight in the range of from about 35% nickel/65% chromium to about 80% nickel/20% chromium. For a TCR less than 0.0050 per degree C, the nickel and chromium mixture has a relative proportion by weight in the range of from 100% chromium to about 95% nickel/5% chromium. For a TCR less than 0.0010 per degree C, the nickel and chromium mixture has a relative proportion by weight in the range of from 40% nickel/60% chromium to 75% nickel/25% chromium. A negligible TCR is produced when the relative proportion by weight of the two metals is 60% nickel/40% chromium.

After the thick film tracks have been applied to the substrate, external connections are added. A suitable electrical connector for making a connection to a thick film track has a cross-sectional area suitable for the required current carrying capacity and comprises a plurality of conductive fibres braided together, each of the fibres having a diameter, preferably in the range of from 30 μm to 300 μm, so as to permit sufficient adhesion of the connector to the thick film track. The connector may be of various metals, the most suitable metal for a particular application depending in part on the material of the thick film track to which the connector is to be adhered. Suitable metals include stainless steel, nickel and copper. The connector is adhered to the track using a glass metal adhesive, advantageously the same conductive ink as used to form the thick film track.

The whole is then overglazed using a protecting glass or glass ceramic overglaze to protect the thick film tracks and allow high temperature stable operation.

Furthermore, the mixed tungsten/nickel and chromium/nickel thick film inks allow the preparation of low cost, high conductivity conductor tracks with low TCR values, ideal for many small appliance applications. Such a combination of properties is unique in a thick film base metal conductor and are usually achieved using precious metals. As such, these inks have further applications in hybrid circuits, particularly those operating at elevated temperature where fairly stable conductivity values are required.

We claim:

1. An electrically resistive track suitable for use in a heating element, said track consisting of a thick film including a base metal constituent and a glass constituent, said thick film having in the temperature range of from 20° C. to 600° C. a temperature coefficient of resistance (TCR) less than 0.0010 per degree C.

2. An electrically resistive track according to claim 1 wherein said metal constituent comprises a mixture of at least two metals.

3. An electrically resistive track according to claim 2 wherein said metal constituent comprises a mixture of nickel and chromium.

4. An electrically resistive track according to claim 3 wherein said mixture has a composition by weight of 60% nickel and 40% chromium.

5. An electrically resistive track according to claim 4 wherein said metal constituent is formed from nickel and chromium powders having an average particle size in the range of from 0.1 μm to 5.0 μm.

6. An electrically resistive track according to claim 2 wherein said metal constituent comprises a mixture of nickel and tungsten.

7. An electrically resistive track according to claim 6 wherein said metal constituent is formed from nickel and tungsten powders having an average particle size in the range of from 0.1 μm to 5.5 μm.

8. An electrically resistive track according to claim 2 wherein said at least two metals having a relative proportion by weight such that the TCR of said thick film is less than the TCR of a thick film having a metal constituent consisting only of any of said at least two metals.

* * * * *